United States Patent [19]

Epstein

[11] 4,426,857

[45] Jan. 24, 1984

[54] STEAMING APPARATUS

[75] Inventor: Eugene G. Epstein, Highland Park, N.J.

[73] Assignee: Epstein Marketing Corp., North Brunswick, N.J.

[21] Appl. No.: 352,697

[22] Filed: Feb. 26, 1982

[51] Int. Cl.[3] ..... D06F 71/34

[52] U.S. Cl. ..... 68/222; 15/323; 248/558

[58] Field of Search ..... 68/5 B, 222; 15/321, 15/323; 248/51, 52, 89, 558; 223/51; 38/69

[56] References Cited

U.S. PATENT DOCUMENTS

| | | | |
|---|---|---|---|
| D. 122,949 | 10/1940 | Utley et al. . | |
| D. 135,680 | 5/1943 | Utley et al. . | |
| 1,809,337 | 6/1931 | Hall . | |
| 2,049,603 | 8/1936 | Dietenberger . | |
| 2,276,809 | 3/1942 | Utley et al. . | |
| 2,369,628 | 2/1945 | Utley et al. . | |
| 2,603,816 | 7/1952 | MacFarland | 15/323 |
| 2,649,927 | 8/1953 | Ortega . | |
| 2,731,103 | 1/1956 | Ortega . | |
| 2,918,692 | 12/1959 | Martinec | 15/323 |
| 2,935,760 | 5/1960 | Martinec | 15/323 |
| 3,089,177 | 5/1963 | Andersson-Sason | 15/323 |
| 3,159,862 | 12/1964 | MacFarland | 15/323 |
| 3,581,529 | 6/1971 | Mitchell et al. | 68/222 |

FOREIGN PATENT DOCUMENTS

| | | | |
|---|---|---|---|
| 57630 | 5/1946 | Netherlands | 15/323 |

OTHER PUBLICATIONS

Brochure Entitled "Steam Away Wrinkles with Jiffy Steamer".

Brochure Entitled "All New Sussman Steamer".

*Primary Examiner*—Philip R. Coe

*Attorney, Agent, or Firm*—Lerner, David, Littenberg, Krumholz & Mentlik

[57] ABSTRACT

An apparatus for spraying steam includes a base having a top surface, an upwardly projecting fixed pole segment and a plurality of downwardly extending openings positioned along the periphery of the top surface. A flexible steam hose includes a first end having a spray nozzle affixed thereto and a second end releasably coupled to a steam generating device within the base. A pole formed from a plurality of pole segments is vertically mounted to the fixed pole segments. The pole segments are constructed and arranged to be received in the openings in the top surface and to extend upwardly therefrom so that the pole segments and the top surface cooperate to form an open enclosure which can be used to retain the flexible hose therein. The nozzle may be suspended from the uppermost end of the pole. A cover is provided to be placed over the upstanding pole segments to provide a self-contained compact steamer with all components stored together.

19 Claims, 5 Drawing Figures

STEAMING APPARATUS

FIELD OF THE INVENTION

This invention relates to devices for spraying steam and particularly to a compact, portable steaming apparatus which is totally self-contained.

BACKGROUND OF THE INVENTION

It has long been known that steam is extremely effective in removing wrinkles from articles of wearing apparel. There have long been available large and cumbersome devices for generating and spraying steam which are typically designed for dry cleaning stores and the like. However, there has been a significant need for smaller, less cumbersome and less expensive devices for lighter and occasional use. For example, retail clothing stores today receive most of their merchandise folded in cartons rather than hanging on racks. In order to make the merchandise available and presentable, it is necessary to either allow the merchandise to hang for a considerable length of time or, alternatively, to use steam to quickly remove wrinkles. If steam can be made available readily and inexpensively, it is obviously preferable to use it in order to make the goods available more quickly.

There are other areas in which there is a substantial need for a smaller and portable steamer. For example, such a device can be used by installers of curtains and draperies to remove wrinkles after the items are mounted. Since curtains and draperies are typically hung in homes and offices, heavy duty industrial type steaming devices are not readily available and there is a need for a portable unit. Similarly, window trimmers and particularly those who service smaller stores which themselves cannot afford any type of steaming apparatus have a need for a portable steam unit.

U.S. Pat. No. 3,581,529 of June 1, 1971 in the name of Bernard A. Mitchell discloses one prior art steaming unit. It includes a base, a flexible hose leading to a spray nozzle, and a pole for supporting the hose in a substantially upright position. Such an arrangement is desirable for two reasons. First, having the nozzle supported at an elevated position makes it easier for the user to pick up and put down the nozzle as desired. Additionally, it has been found that problems develop when a hose in a steaming unit is allowed to lay horizontally in that water could be emitted from the nozzle, thus causing spotting of material. By suspending the spray nozzle at an elevated location, any water which might condense within the hose will tend to fall back into the steam generating area within the base.

The upstanding pole in the aforesaid U.S. Pat. No. 3,581,529 is formed from several segments, which allows the otherwise cumbersome pole to be broken down into more manageable sizes. However, the aforesaid U.S. Pat. No. 3,581,529 does not provide any means for storing the pole segments when the unit is not in use; nor does it disclose any means for storing the flexible hose. Additionally, the entire unit is not particularly portable and there does not appear to be any particularly handy way to transport the item or any of its components.

Other products, such as a steamer sold under the trademark Jiffy by the Jiffy Steamer Company of Union City, Tennessee, provide a base for generating the steam which has wheels and thus renders the base itself portable. However, there is no provision for storing and transporting the entire unit so that all the components must be carried separately.

Accordingly, it is an object of the present invention to provide a steaming apparatus which is portable and compact.

It is a further object of the present invention to provide such a steaming apparatus which includes a flexible hose and which provides a means for storing the flexible hose with the remainder of the unit.

It is yet another object of the present invention to provide such a steaming apparatus which provides an upstanding pole for supporting the flexible hose wherein the upstanding pole can be stored with the remainder of the components in a compact fashion.

Various other objects and advantages of the present invention will become clear from the following detailed description of an exemplary embodiment thereof, and the novel features will be particularly pointed out in conjunction with the claims appended hereto.

SUMMARY OF THE INVENTION

In accordance with the teachings of the present invention, an apparatus for spraying steam includes a flexible steam transporting hose. Pole means for providing a pole support for the flexible hose includes a plurality of interconnectable pole segments which form the pole support when connected together. A base means includes a top surface and mounting means for mounting the pole support. An enclosure forming means includes a plurality of openings in the top surface of the base means. The openings are adapted to receive the pole segments and support them in an arrangement such than an open enclosure is formed by the cooperation of the pole segments and the top surface of the base means. The open enclosure has a size such that at least the major portion of the flexible hose can be contained therein. The invention will be more fully understood by reference to the following detailed description of an exemplary embodiment thereof in conjunction with the accompanying drawings in which:

DESCRIPTION OF THE PREFERRED EMBODIMENT

Figure 1:
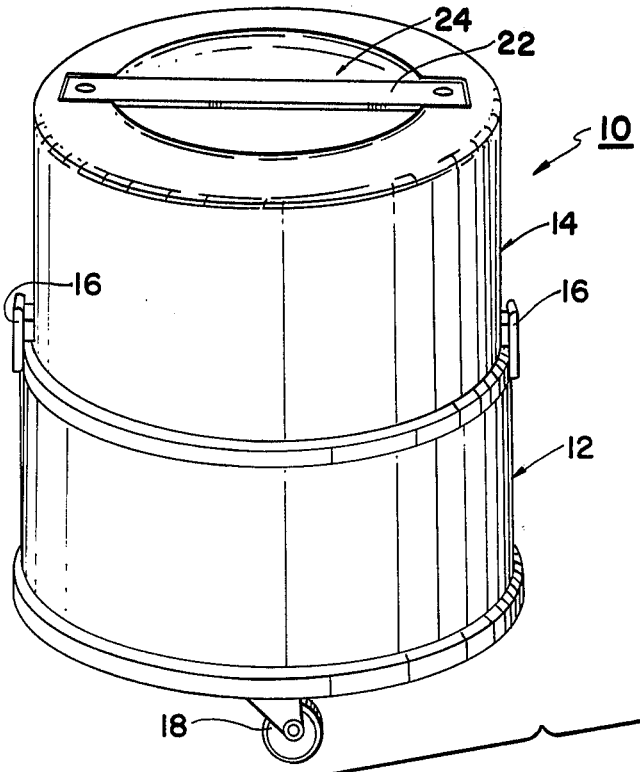
FIG. 1 is a perspective view of the steaming apparatus of the present invention wherein the flexible hose and the pole are disassembled for storage and wherein a cover is in place over the base.
Figure 4:
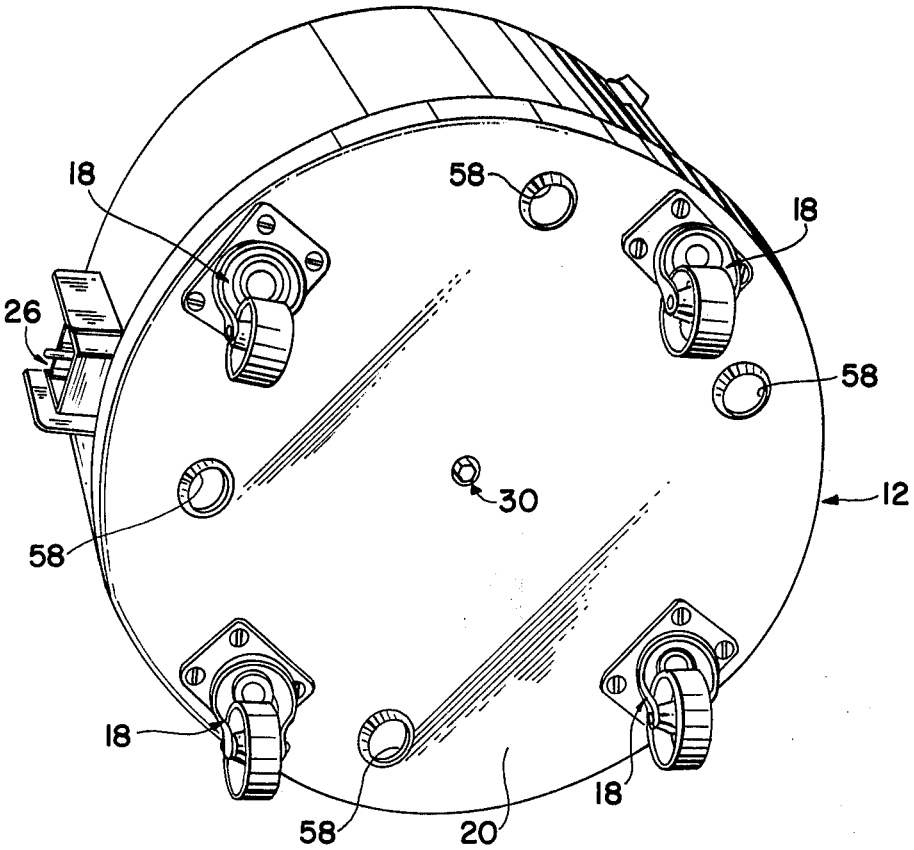
FIG. 4 is a bottom perspective view of the steamer of the present invention.

Referring now to the drawings, wherein like reference numerals designate like parts throughout the several views, and more particularly to FIG. 1, there is shown a steamer of the present invention indicated generally by reference numeral 10. As illustrated in FIG. 1, the steamer 10, when it is not assembled and ready for use, is completely compact and self-contained. The steamer 10 includes a base 12 and a cover 14, both of which are made from a plastic material. Latches 16 mounted to the cover 14 allow the cover 14 to be securely but releasably mounted to the base 12. Casters 18 are rigidly mounted to the underside 20 of the base 12 by engagement with a cooperating member 17 on the base 12. FIG. 4 best illustrates the mounting and placement of the casters 18, which are preferably four in number.

As illustrated in FIG. 1, the cover 14 includes a handle 22 mounted to the top thereof. A concave depression 24 in the top surface of the cover 14 allows the handle 22 to be easily grasped. When the unit is fully packed and closed as shown in FIG. 1, the handle 22 in conjunction with the casters 18 allow for very easy movement of the entire steamer 10.

The base 12 includes a steam generator in the interior thereof (not shown), which is electrically operated. Electricity is supplied to the unit through plug 26. Power to the unit is turned on and off by a lighted on and off rocker switch 28. A safety feature is provided whereby whenever the unit has less than eight ounces of water remaining, it automatically shuts itself off and the aforementioned light goes off. In order to restore power to the unit, it is necessary to push reset button 30 located on the underside of the unit, as best seen in FIG. 4. As will become more clear below, the steam generating apparatus within the base 12 is located near the center of the base 12, while the outer portion of the interior of the base 12 is substantially open.

Figure 3:
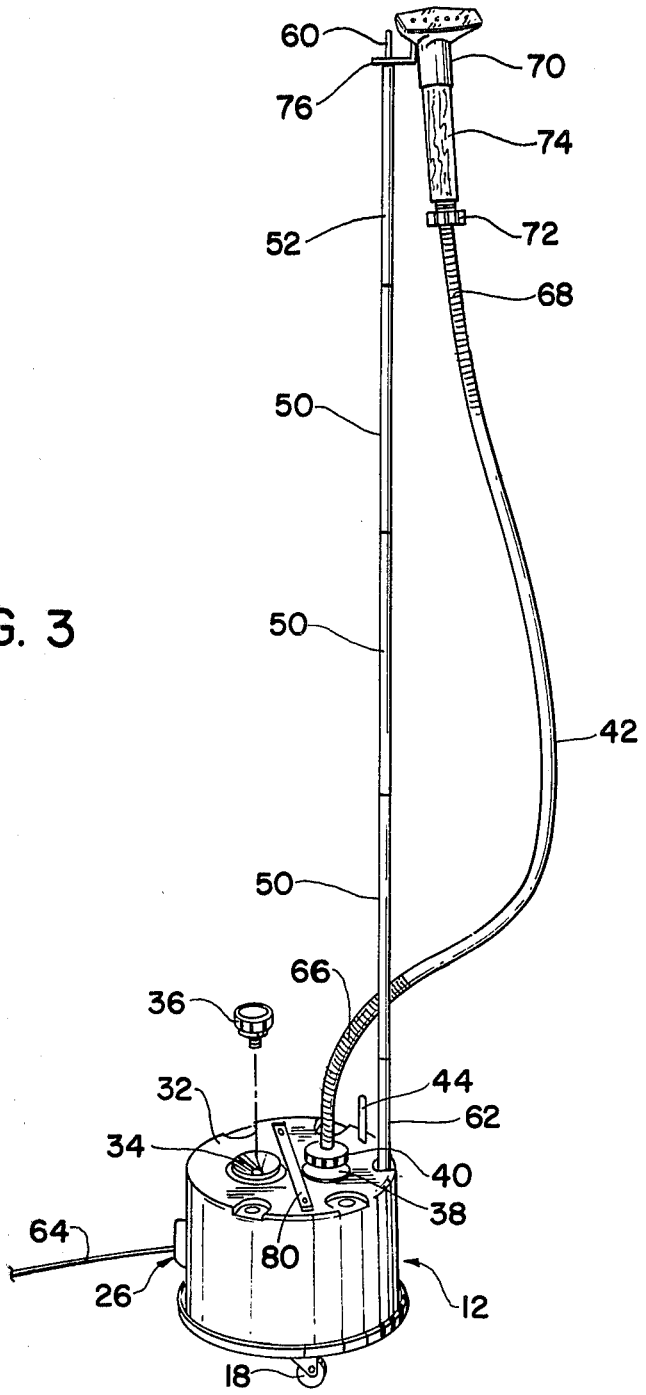
FIG. 3 is a perspective view of the steamer of the present invention shown fully assembled and in position for use.

As can be best seen in FIG. 3, the top surface 32 of the base 12 includes an inlet 34 having a funnel shape to facilitate the addition of water. While the addition of water can be further facilitated by the use of a separate funnel with a wider opening, if one is not available, water can still be readily inserted by virtue of the funnel shape in the inlet 34. A stopper 36 includes a safety valve (not shown) which allows for release of pressure within the steam generating unit in the event that there is some malfunctioning of the unit.

FIG. 3 also illustrates the steam outlet 38 which is connected directly to the steam generating unit. A coupling member 40 made of plastic provides a releasable coupling between the steam outlet 38 and the flexible hose 42, which will be discussed in more detail below. The top surface 32 of the base 12 also includes a small slot which receives and retains a dip stick 44. The dip stick 44 can be inserted into the inlet 34 to ascertain how much water is in the unit and whether water must be added or poured out.

Figure 2:
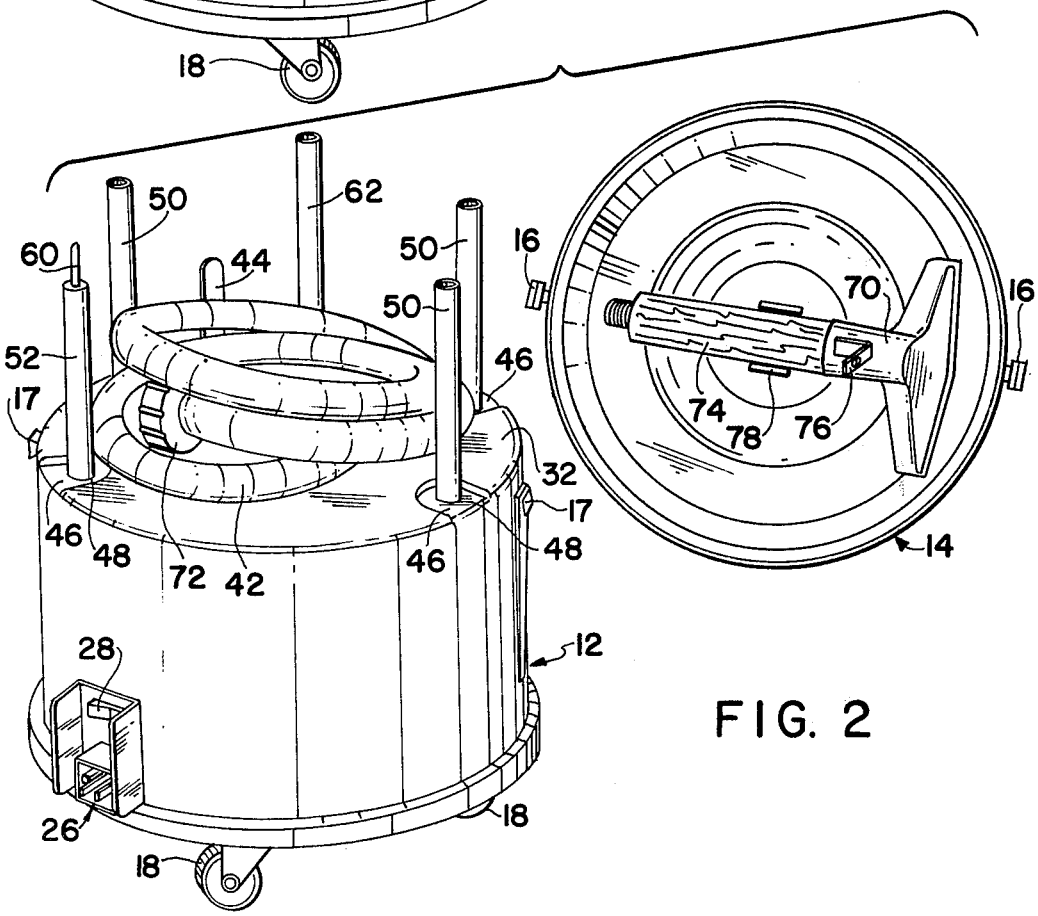
FIG. 2 is a perspective view similar to FIG. 1 in which the cover has been removed and which illustrates the storage of the pole segments and the flexible hose on the base and which illustrates the interior of the cover which provides a storage location for the nozzle.
Figure 5:
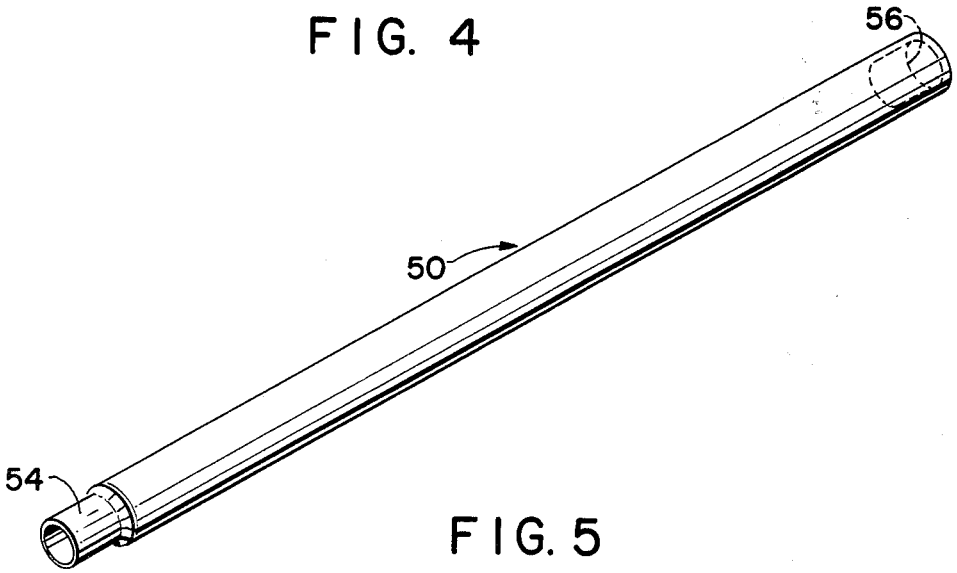
FIG. 5 is a perspective view of a typical pole segment used in conjunction with the present invention.

As shown in FIG. 2, the top surface 32 includes a series of embossed depressions 46 which include a hole 48. Inserted in the holes 48 are the intermediate pole segments 50 and the upper pole segment 52, all of which are made of aluminum. The construction of the intermediate pole segments is illustrated in FIG. 5. The pole segments 50 include a reduced diameter section 54 on one end and a reamed out opening 56 at the opposite end. The reamed out opening 56 is dimensioned so as to accommodate the reduced diameter section 54 of a similar pole segment 50. In the preferred embodiment, the intermediate pole segment 50 has an overall length of approximately $13\frac{3}{4}$ inches. The reduced diameter section 54 is $\frac{3}{4}$ of an inch long and has a nominal diameter of 0.650 inch. The reamed out opening is approximately one inch deep and has a nominal diameter of 0.655 inch, to provide a light press fit between adjacent pole segments 50. The pole segment 50 itself has a nominal cross-sectional diameter of $\frac{3}{4}$ inch and is formed from tubing.

As seen in FIG. 4, the underside 20 of the base 12 has four holes 58. The holes 58 correspond vertically with the holes 48. The diameter of the holes 58 is preferably approximately 45/64 inch, which is greater than the diameter of the reduced diameter section 54 of the intermediate pole segments 50, but smaller than the nominal diameter of the intermediate pole segment 50.

Returning now to FIG. 2, and recalling that the steam generating unit is confined to the center of the interior of the base 12, leaving the peripheral portion open, it can now be appreciated that the intermediate pole segments 50 are securely stored within the base 12. They are inserted in the holes 48 with the reduced diameter section 54 facing downward and extend through the base 12 through the holes 58 in the underside 20 of the base. Since the diameter of the holes 58 exceeds the diameter of the reduced diameter section 54 but is less than the diameter of the body of the pole segments 50, the pole segments 50 rest securely in the holes 58 and the holes 48.

The upper pole segment 52 differs from the intermediate pole segments 50 in that instead of having a reamed opening 56 at the top end, there is a narrow pin 60 which is used in connection with suspending the nozzle, as discussed below. The overall length of upper pole segment 52 is slightly longer than that of intermediate pole segment 50.

The base 12 is preferably approximately $7\frac{1}{2}$ inches tall. Since the intermediate pole segments 50 and the upper pole segment 52 are roughly twice as long as the base 12 is high, a substantial portion of the intermediate pole segments 50 and the upper pole segment 52 extend upwardly above the top surface 32 of the base 12 while the pole segments are being stored in the base 12.

Also projecting upward from the top surface 32 of the base 12 is a fixed pole segment 62, which is rigidly mounted to the base 12. This can be accomplished in many ways, such as threading the lower portion of the fixed pole segment 62 and engaging it with a matching threaded element in the interior of base 12. Irrespective of how it is accomplished, the fixed pole segment 62 acts as a mounting means for the remainder of the pole, as discussed in greater detail hereinafter.

As can be seen in FIG. 2, the intermediate pole segments 50, the upper pole segment 52 and the fixed pole segment 62 are located near the periphery of the top surface 32 of the base 12 and are spaced about the top surface 32 in a substantially uniform manner. The five upstanding pole segments provide a "cage" and, in cooperation with the top surface 32 form an enclosure which is sufficiently large to store the hose 42 when it is rolled up. Additionally, the electrical cord 64 can also be rolled up and placed within the enclosure formed by the pole segments and the top surface.

FIG. 3 illustrates the steamer of the present invention when it is fully assembled. The three intermediate pole segments 50 are stacked up atop the fixed pole segment 62, and the upper pole segment 52 is placed at the top of the uppermost intermediate pole segment 50, so that the narrow pin 60 forms the top of an elongated pole formed by the several segments.

The hose 42 is formed from high pressure clear vinyl tubing having an outer diameter of $\frac{7}{8}$ inch and an inner diameter of $\frac{5}{8}$ inch. A stainless steel spring 66 is placed within the hose 42 near the bottom and a similar stainless steel spring 68 is placed within the upper end of the hose 42. The springs 66 and 68 provide the hose 42 with a degree of rigidity at the two ends which facilitates use. A nozzle 70 is coupled to the upper end of the hose 42 with coupling member 72 made of plastic. The nozzle 70 has a wood handle 74 which is designed to stay relatively cool notwithstanding the hot steam which passes therethrough. On the back of the nozzle 70 there is affixed a bracket 76 having a hole therein with a diameter, greater than the diameter of the narrow pin 60 but less than the nominal diameter of the upper pole segment 52, so that the nozzle 70 can be readily rested on top of the pole.

FIG. 2 illustrates how the nozzle 70 is stored within the cover 14 of the steamer. A metal clip 78 is mounted to the inside of the cover 14 and is sufficiently springy so that the nozzle 70, when disconnected from the hose 42, can be readily snapped in and retained within the cover 14 until it is needed again.

It will be appreciated that the outer part of the cover 14 must have a depth sufficient to accommodate the intermediate pole segments 50, the upper pole segment 52 and the fixed pole segment 62 when they are all extending upward from the base 12. Additionally, the central part of the cover 14 should preferably be deep enough to accommodate the rolled up hose 42, the rolled up electrical cord 64, and the nozzle 70 projecting downwardly from the top of the cover 14. The cover 14 of the preferred embodiment has a maximum overall height of approximately 6½ inches.

It will be appreciated that the steamer of the present invention, in the fully assembled configuration shown in FIG. 3, can be readily moved along the floor by virtue of the casters 18. In the event that one wishes to lift the unit, this cannot be done by lifting the upstanding pole, since the pole segments in the preferred embodiment are mounted to each other in a manner which will withstand compression but not tension. Accordingly, a handle 80 is provided on the top surface 32 of the base 12 by which the unit can be readily lifted. The unit can also be lifted by lifting the fixed pole segment 62. The handle 80 is preferably centrally located within the top surface 32 so that the base 12 does not tip over appreciably when lifted.

It will be understood by those skilled in the art that there are other ways in which the present invention can be utilized. For example, the means for mounting the pole need not necessarily be an upstanding fixed pole segment 62; instead, there could be socket formed within the base 12 into which the pole segments can be inserted. Additionally, one could provide pole segments which can be threaded to each other or attached to each other in a somewhat more rigid fashion. While such added rigidity might be desirable in that it would allow one to lift the unit by lifting the pole, this would tend to increase the amount of time needed to assemble and diassemble the unit.

As will be readily apparent to those skilled in the art, the invention may be used in some other specific forms of steaming apparatus without departing from its spirit or essential characteristics. The present embodiments are, therefore, to be considered as illustrative and not restrictive, the scope of the invention being indicated by the claims rather than the foregoing description, and all changes which come within the meaning or range of equivalence of the claims are therefore intended be embraced therein.

What is claimed is:

1. Apparatus for spraying steam comprising:

a flexible steam transporting hose;

pole means for providing a pole support for said flexible hose, said pole means including at least three interconnectable pole segments which form said pole support when connected together;

base means including a top surface and mounting means for mounting said pole support; and enclosure forming means comprising a plurality of spaced openings in said top surface of said base means adapted to receive said pole segments within the interior of said base means and support them in an arrangement such that an open enclosure is formed by the cooperation of said at least three pole segments and said top surface of said base means, said open enclosure having a size such that at least the major portion of said flexible hose can be contained therein.

2. Apparatus according to claim 1 wherein said flexible hose includes a first end having a spray nozzle affixed thereto and a second end and further comprising steam generating means within said base means and means for releasably coupling said second end of said flexible hose to said steam generating means.

3. Apparatus according to claim 1 wherein said openings are positioned proximate the periphery of said top surface of said base.

4. Apparatus according to claim 1 wherein said mounting means comprises a bottom pole segment rigidly mounted to said base.

5. Apparatus according to claim 4 wherein said bottom pole segment cooperates with said pole segments to define said open enclosure.

6. Apparatus according to claim 5 wherein said openings and said bottom pole segment are positioned proximate the periphery of said top surface of said base.

7. Apparatus according to claim 1 wherein the spacing between said openings is substantially uniform.

8. Apparatus according to claim 1 further comprising means for rendering said base means portable.

9. Apparatus according to claim 1 or claim 3 or claim 8 wherein said pole segments are of substantially equal length.

10. Apparatus according to claim 1 wherein said enclosure has a size such that an electrical cord can also be contained therein.

11. Apparatus for spraying steam comprising:

a base including steam generating means disposed therein, a top surface, a plurality of spaced downwardly extending openings positioned within said top surface, and means for mounting an upwardly extending pole;

a flexible steam hose including a first end having a spray nozzle affixed thereto and a second end;

means for releasably coupling said second end of said hose to said steam generating means;

pole means adapted to be vertically mounted to said mounting means, said pole means being formed from at least three interconnectable pole segments, said pole segments being constructed and arranged to be received in said openings in said top surface of said base, to extend downwardly through said base, and to extend upwardly therefrom so that said at least three pole segments when positioned in said openings cooperate with said top surface of said base to form an open enclosure for containing said hose therein; and means for releasably suspending said nozzle from the uppermost end of said pole means.

12. Apparatus according to claim 11 wherein said openings are positioned proximate the periphery of said top surface of said base.

13. Apparatus according to claim 11 wherein said mounting means comprises a bottom pole segment rigidly mounted to said base.

14. Apparatus according to claim 13 wherein said bottom pole segment cooperates with said pole segments to define said open enclosure.

15. Apparatus according to claim 14 wherein said openings and said bottom pole segment are positioned proximate the periphery of said top surface of said base.

16. Apparatus according to claim 11 wherein the spacing between said openings is substantially uniform.

17. Apparatus according to claim 11 further comprising means for rendering said base portable.

18. Apparatus according to claim 11 or claim 12 or claim 16 wherein said pole segments are of substantially equal length.

19. Apparatus for spraying steam comprising:

pole means for providing a pole support for a flexible hose, said pole means including at least three interconnectable pole segments which form said pole support when connected together;

base means including a top surface and mounting means for mounting said pole support; and means for storing said pole segments within said base and for retaining a flexible hose on said top surface of said base, wherein said storing and retaining means comprises a plurality of spaced downwardly extending openings in said top surface of said base means adapted to receive said pole segments and support them in an arrangement such that an open enclosure is formed by the cooperation of said pole segments and said top surface of said base means, said open enclosure having a size sufficient to contain a flexible hose there.

* * * * *